US007003856B2

(12) United States Patent
Hayashi et al.

(10) Patent No.: US 7,003,856 B2
(45) Date of Patent: Feb. 28, 2006

(54) METHOD AND APPARATUS FOR OPENING CONTINUOUS FILAMENTS

(75) Inventors: Hiroo Hayashi, Kagawa (JP); Kodai Furuya, Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 764 days.

(21) Appl. No.: 09/935,407

(22) Filed: Aug. 23, 2001

(65) Prior Publication Data

US 2002/0026699 A1 Mar. 7, 2002

(30) Foreign Application Priority Data

Sep. 1, 2000 (JP) ..... 2000-265458

(51) Int. Cl.
*D01D 11/02* (2006.01)

(52) U.S. Cl. ..... 28/282

(58) Field of Classification Search ..... 28/282, 28/283, 220, 219, 248, 240, 241, 247, 259, 28/260, 278; 19/65 T, 66 T, 65 A; 264/168, 264/280, 282–285, 290.2, 290.5, 290.7, 299, 264/292, 288.4, 69–71
See application file for complete search history.

(56) References Cited

U.S. PATENT DOCUMENTS

| | | | | | |
|---|---|---|---|---|---|
| 2,244,203 | A | * | 6/1941 | Kern | 28/282 |
| 2,790,208 | A | * | 4/1957 | Smith | 28/282 |
| 2,801,455 | A | * | 8/1957 | McLellan | 28/282 |
| 2,811,770 | A | * | 11/1957 | Young, Jr. | 28/282 |
| 3,345,697 | A | | 10/1967 | Aspy, Jr. | |
| 3,438,104 | A | * | 4/1969 | Stoller | 28/282 |
| 3,501,811 | A | | 3/1970 | Watson | |
| 3,739,564 | A | * | 6/1973 | King | 19/65 T |
| 3,865,565 | A | * | 2/1975 | Spence et al. | 28/282 |
| 4,509,452 | A | * | 4/1985 | Pryor | 28/282 |
| 5,000,807 | A | * | 3/1991 | Stuart | 28/282 |
| 5,042,122 | A | * | 8/1991 | Iyer et al. | 28/283 |
| 5,146,651 | A | * | 9/1992 | Duffy et al. | 19/65 T |
| 5,214,828 | A | * | 6/1993 | Neuert et al. | 28/282 |
| 6,049,956 | A | * | 4/2000 | Lifke et al. | 28/282 |
| 6,687,564 | B1 | * | 2/2004 | Baudry et al. | 28/282 |
| 6,743,392 | B1 | * | 6/2004 | Tanaka et al. | 264/444 |

FOREIGN PATENT DOCUMENTS

| | | | |
|---|---|---|---|
| DE | 586060 | | 9/1933 |
| DE | 586060 | A1 | 10/1933 |
| DE | 586060 | * | 10/1933 |
| DE | 1921182 | A1 | 11/1970 |
| DE | 1921182 | | 11/1970 |
| DE | 42 21 163 | A1 | 1/1993 |
| GB | 1 230 122 | A1 | 4/1971 |

OTHER PUBLICATIONS

Database WPI, Section C, Week 197527 Derwent Publications Ltd., London GB; AN 1975–45381W, XP002250616 & JP 50 015884B (Daicel Ltd.) Jun. 9, 1975, Abstract.
Australian Search Report.
Derwent Abstract Accession No. 35261W/21, JP 50–010962 A (Teijin KK), Apr. 25, 1975, Abstract and Figure.
Derwent Abstract Accession No. 45381W/27, JP 50–015884 A (Deicel KK), Jun. 9, 1975, Abstract and Figure.

* cited by examiner

*Primary Examiner*—Amy B. Vanatta
(74) *Attorney, Agent, or Firm*—Darby & Darby

(57) ABSTRACT

A method and an apparatus for opening continuous filaments provide stable quality of fibrous layer after opening crimped TOW. The TOW is transported by means of a plurality of rolls. While transported, the TOW is applied a resistance on one side of the TOW by slidingly contacting a sliding body onto the TOW at between rolls. As a result, continuous filaments stacked in a thickness direction of the TOW are caused to sift in a transporting direction of the TOW. Thus, the TOW is opened and the continuous filaments are spread in a width direction of the TOW.

7 Claims, 8 Drawing Sheets

METHOD AND APPARATUS FOR OPENING CONTINUOUS FILAMENTS

BACKGROUND OF THE INVENTION

1. Field of the Invention

The present invention relates generally to a method and an apparatus for opening crimped TOW to prepare opened continuous filaments, to be used as a surface layer of an absorbent article, such as sanitary napkin, or for other application.

2. Description of the Related Art

For a surface layer of an absorbent article, such as sanitary napkin, conjugated synthetic fibers of core-sheath structure, such as those of PE/PP, PE/PET or the like are used. As the conjugated synthetic fibers, continuous filaments may be used.

The continuous filaments are supplied to a manufacturing process of absorbent article or so forth in a form of TOW, in which filaments are bundled to firmly contact with each other and are crimped. In the manufacturing process, opening process is preformed to separate the continuous filaments from each other in the width direction of the TOW and to increase apparent width. The continuous filaments thus separated in the width direction in the opening process to have a uniform bulkiness, are used for production of the surface layer of the absorbent article or the like.

Conventionally, the following method is employed for opening the TOW.

At first, the TOW is supplied to a transporting roll group which is constructed such that downstream side roll has higher peripheral speed than that of upstream side roll for applying tension force to the TOW between the rolls. Then, the TOW is transferred to a transporting roll group which is constructed such that downstream side roll has lower peripheral speed than that of the upstream side roll for releasing the tension force. Application of tension force and release of tension force are effected, respectively at least one time. In this method, the tension force is applied to the continuous filaments forming the TOW for stretching crimp, and then, the filaments are elastically contracted to restore crimp. By stretching crimp and restoring crimp, the continuous filaments are given dispersing force in the width direction of the TOW.

As an alternation, there is another method for opening the TOW, in which a threaded roll formed with circumferentially extending grooves at a given pitch in the axial direction, is driven to rotate and the TOW is supplied onto the surface of the rotating threaded roll for opening. In this method, tension forces to be applied to the continuous filaments are varied between portions of the threaded roll where the grooves are present and portions of the threaded roll where the grooves are not present. By variation of tension force, the continuous filaments forming the TOW are locally stretched and locally contracted and whereby to apply dispersion force in the width direction of the TOW.

In the further alternative, there is still another method for opening the TOW, in which an air jet is applied along longitudinal direction of the TOW. In this method, by blowing force of air, dispersing force of the continuous filaments is applied in the width direction of the TOW.

However, in the method where different peripheral speeds are provided for rolls in the transporting roll group, opening condition of the TOW depends on the peripheral speeds of the rolls, nip pressure of the rolls, materials of the roll surfaces and the like. Similarly, in the method employing the threaded roll, opening condition depends on nip pressure of the roll, material of the surface of the roll, size of each groove and the like.

Accordingly, when bundling condition of the TOW, basis weight of the TOW, fineness of continuous filaments or material of continuous filaments is varied, optimal opening may sometimes be impossible under the same condition. In such case, preparatory operation for varying various conditions is quite difficult and huge amount of cost is required for varying facility configuration.

On the other hand, in the method where the TOW is opened by air jet, since continuous filaments are separated by air flow, it is difficult to achieve uniformity in opening.

SUMMARY OF THE INVENTION

The present invention has been worked out in view of the problem set forth above. Therefore, it is an object of the present invention to provide a method and an apparatus for opening continuous filaments, which can uniformly open crimped TOW and can easily vary opening condition even when material or kind of TOW is varied.

According to a first aspect of the invention, there is provided an opening method of continuous filaments, comprising the steps of:

transporting crimped TOW by means of a plurality of rolls; and applying a resistance on at least one side of the TOW by slidingly contacting at least one sliding body onto the TOW at between rolls, whereby continuous filaments stacked in a thickness direction of the TOW are caused to sift in a transporting direction of the TOW to open the TOW and to spread the continuous filaments in a width direction of the TOW.

According to the opening method of the invention, by pushing the sliding body (for example, of a plate shape) against the TOW to make the TOW slidingly contact with the sliding body, a shifting force in the transporting direction of the TOW can be effectively applied to the continuous filaments in the thickness direction of the TOW, to thereby open the TOW. When the continuous filaments are separated from one another by opening, repulsive forces are caused between adjacent filaments due to contact between peaks and bottoms of crimps, so that the filaments are effectively spread in the width direction of the TOW.

It is preferred that a plurality of sliding bodies are provided in the resistance-applying step, and that each side of the TOW is slidingly contacted by at least one of the sliding bodies.

It is also preferred that each sliding body is adjustable of a tilt angle relative to a line perpendicular to transporting path of the TOW and a penetration amount into the transporting path of the TOW. The adjusting operation may be performed manually, but it is preferred that the opening method further comprises a step of detecting a width of spread continuous filaments after slidingly contacting with the sliding bodies, and a step of automatically adjusting the tilt angle and the penetration amount of the sliding bodies on the basis of the detected value.

Peripheral speeds of rolls located at upstream side and downstream side of the sliding body may be the same. But, it is preferred that among rolls located at upstream side and downstream side of the sliding body, the peripheral speed of the roll located at downstream side is set higher than that of the roll located at upstream side for applying tension force on the TOW between the rolls.

According to another aspect of the invention, there is provided an opening apparatus of continuous filaments, comprising:

a transporting roll group for transporting crimped TOW of continuous filaments; and at least one sliding body arranged between rolls of the transporting roll group for slidingly contacting with the TOW to be transported.

This opening apparatus may be constructed such that at least one sliding body is provided on one side of the TOW and at least one sliding body is provided on the other side of the TOW.

It is preferred that the opening apparatus further comprises:

detecting means for detecting a width of spread continuous filaments after slidingly contacting with the sliding body;

adjusting means for adjusting a tilt angle of the sliding body relative to a line perpendicular to transporting path of the TOW and a penetration amount of the sliding body into the transporting path of the TOW; and control means for controlling the adjusting means for varying the tilt angle and the penetration amount of the sliding body on the basis of the detected value by the detecting means.

The rolls located at upstream side and downstream side of the sliding body may be driven to rotate at the same peripheral speed. But, it is preferred that among rolls located at upstream side and downstream side of the sliding body and driven to rotate, the peripheral speed of the roll located at downstream side is set higher than that of the roll located at upstream side.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific detailed. In the other instance, well known structure are not shown in detail in order to avoid unnecessary obscurity of the present invention.

Figure 1:
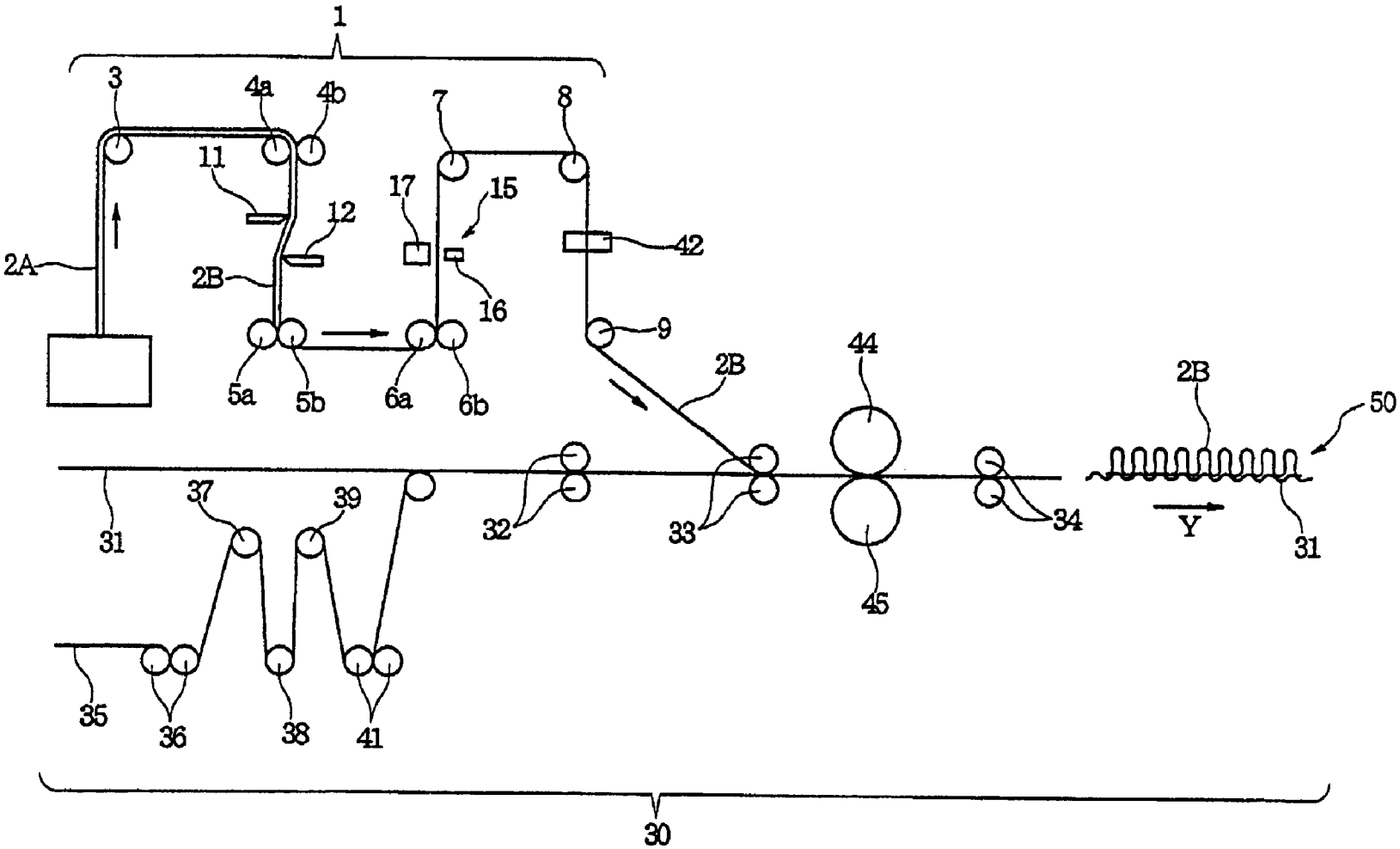
FIG. 1 is an explanatory illustration for showing a method and an apparatus for manufacturing a surface layer of an absorbent article including an opening method and an opening apparatus according to the present invention.
Figure 2:
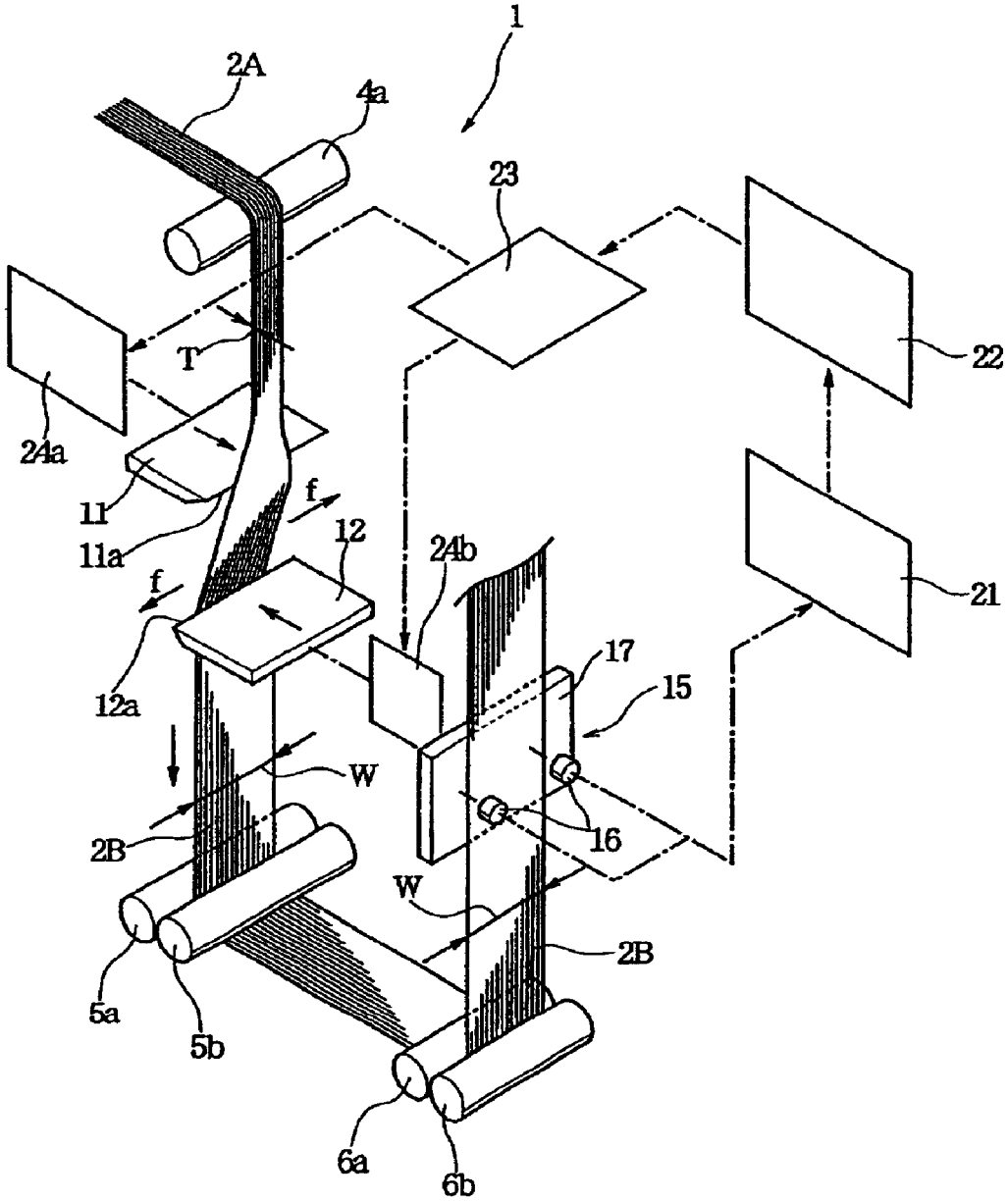
FIG. 2 is an enlarged perspective view of the opening method and opening apparatus of FIG. 1.

FIG. 1 is an explanatory illustration for showing a method and an apparatus for manufacturing a surface layer of an absorbent article including opening method and opening apparatus according to one embodiment of the present invention, and FIG. 2 is an enlarged perspective view of the opening method and opening apparatus of FIG. 1.

In opening process 1 of continuous filaments shown in FIGS. 1 and 2, TOW 2A, in which continuous filaments are bundled and crimped, is supplied and opened to be uniform in width direction.

Continuous filaments forming TOW 2A may be conjugated synthetic fibers of core-sheath structure, such as those of PE/PET, PE/PP or the like, side-by-side type conjugated fibers, such as those of PE/PET, PE/PP or the like, or mono-fibers, such as those of PE, PP, PET or the like.

Crimping is performed by means of a crimper upon manufacturing of filaments and number of crimp is increased by pre-heating calender or hot air process. For example, crimping condition of the TOW is that number of crimp per 1 inch of one continuous filament is in a range of 5 to 40 or in a range of 15 to 30, and after opening, crimp modulus of elasticity of one continuous filament is greater than or equal to 70%.

Number of crimp is based on JIS L-1015 and crimp modulus of elasticity is based on JIS L-1074. In case of the filament of a fineness less than 5.5 dtex, an initial load of 0.49 mN is applied in pulling direction, and in case of the filament of a fineness greater than or equal to 5.5 dtex, an initial load of 0.98 mN is applied in pulling direction. Number of crimp referred to is number of threads (peaks) per 1 inch (25 mm) when the initial load is applied.

On the other hand, the crimp modulus of elasticity is expressed by:

$$\{(b-c)/(b-a)\}\times 100(\%)$$

wherein a is a length of filament when the initial load is applied, b is a length when the crimp is stretched by applying a tension force of 4.9 mN per 1.1 dtex for 30 seconds, and c is a length as applied the initial load again after 2 minutes from releasing of the tension force.

When opened TOW is used for a surface layer of an absorbent article, the continuous filaments are preferably treated to be hydrophilic with a hydrophilic agent being applied to their surfaces or kneaded in the resin. It is also preferred that the continuous filaments contain inorganic filler for whitening, such as titanium oxide or the like, in the content of 0.5 to 10% by weight. By whitening process, the continuous filaments may easily hide menstrual blood or the like absorbed in an absorbent layer of an absorbent article from external view. The individual continuous filaments may have a circular or modified cross-section.

In the opening process 1, TOW 2A is transported toward right in the drawing by means of a transporting roll group composed of rolls 3, 4*a*, 4*b*, 5*a*, 5*b*, 6*a*, 6*b*, 7, 8 and 9. Between the paired rolls 4*a* and 4*b* and the paired rolls 5*a* and 5*b*, sliding plates 11 and 12 as sliding bodies are provided. The sliding plates 11 and 12 are placed in opposition relative to the TOW 2A and with offset in transporting direction of the TOW. As shown in FIG. 2, the front edges 11*a* and 12*a* of respective sliding plates 11 and 12 extend in straight in width direction of the TOW. In the shown embodiment, the front edges 11*a* and 12*a* are chamfered to have a wedge-shaped section, but may be otherwise chamfered to have a curved section or the like. Of course, it is possible not to chamfer the front edges 11*a* and 12*a*. The front edges 11*a* and 12*a* so extend as to permit sliding of the entire TOW 2A.

It is also possible that the front edges 11*a* and 12*a* extend in a curved (arcuate) shape or in a corrugated shape. In case of curved (arcuate) shape, the center portion of respective front edges 11*a* and 12*a* is recessed away from the TOW 2A. In case of corrugated shape, convex shape projecting toward the TOW 2A and concave shape recessed away from the TOW 2A are repeated in the width direction of the TOW.

Figure 3:
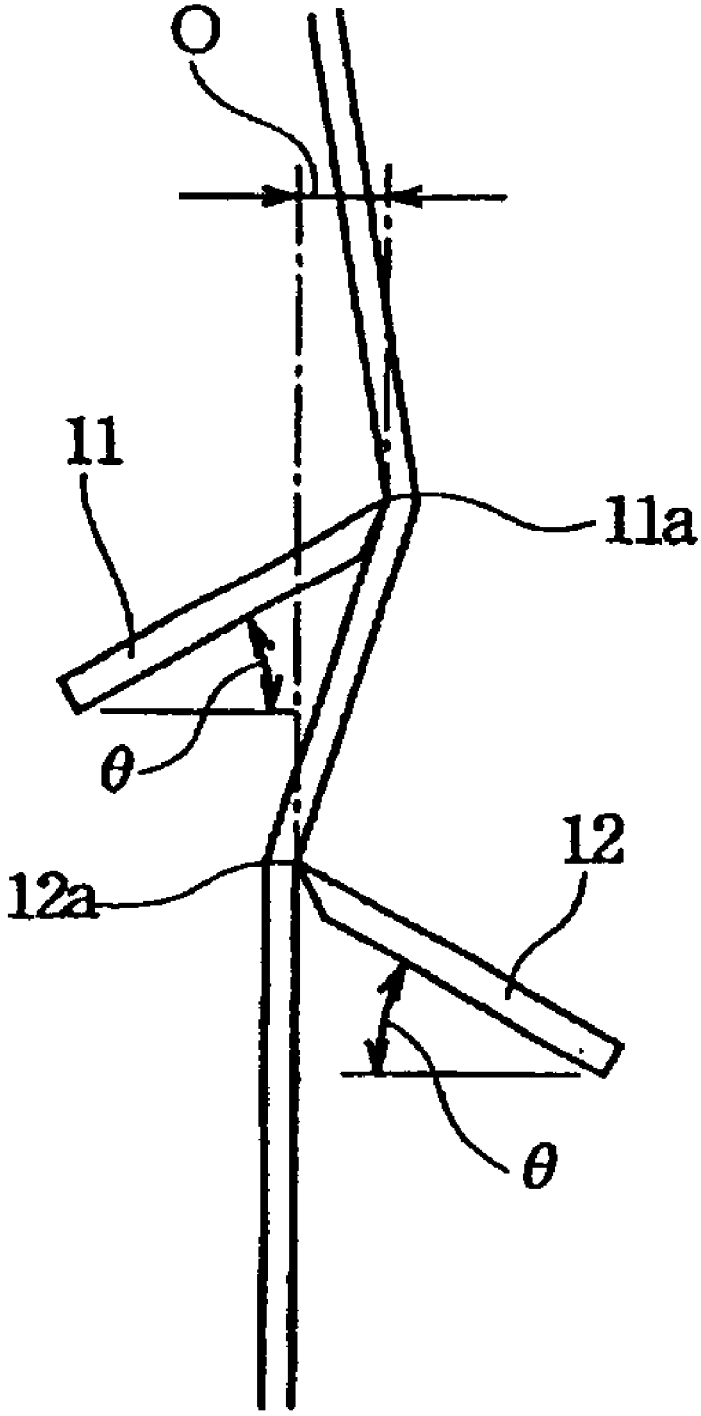
FIG. 3 is an enlarged side elevation showing a contact condition between a sliding plate and TOW.

On the other hand, as shown in FIG. 3, the front edge 11*a* of the sliding plate 11 and the front edge 12*a* of the sliding plate 12 are preferably located to penetrate into a transporting path of the TOW 2A. Here, the transporting path of the TOW 2A is meant to indicate a path extending in straight between the paired rolls 4*a* and 4*b* and the paired rolls 5*a* and 5*b*. In FIG. 3, the transporting path extends vertically. Furthermore, it is preferred to provide an overlapping amount (overhanging amount) 0 between the sliding plates 11 and 12 (as expressed by a distance between the front edges 11*a* and 12*a* in the horizontal direction of FIG. 3). Also, in order to increase friction force in sliding between the front edges 11*a* and 12*a* and the TOW 2A, it is preferred to set tilt angle θ for the sliding plates 11 and 12 relative to a line perpendicular to transporting path of the TOW 2A (horizontal line in the shown case). Particularly, the tilt angle θ is preferably set to orient the front edges 11*a* and 12*a* upwardly. However, it is also possible to set the tilt angle θ to orient the front edges 11*a* and 12*a* downwardly for absorbing increased magnitude of friction force in sliding associating with increasing of overlapping amount O.

When the TOW 2A is transported while sliding on the front edges 11*a* and 12*a* of the sliding plates 11 and 12, at first, one side of the TOW 2A receives the resistance from the sliding plate 11. By this sliding resistance, a shifting force in the transporting direction acts on individual continuous filaments stacked in thickness direction of the TOW 2A to separate adjacent filaments from each other. More specifically, when separated by application of the shifting force, the individual filaments, which have been firmly fitted with each other in a condition with matching phase of crimp before opening the TOW, are brought into contact with each other in a condition with shifting phase of crimp. Accordingly, repulsive forces f and f are caused between adjacent filaments due to contact between peaks and bottoms of crimps, so that the filaments are uniformly spread in the width direction of the TOW.

Next, the other side of the TOW 2A receives the resistance from the sliding plate 12. Accordingly, a shifting force in the transporting direction is also applied to individual continuous filaments stacked in thickness direction of the TOW 2A, for further opening. Thus, the TOW 2A is further spread to have a width W. In the drawings, TOW opened to have the width W is indicated at 2B. Hereinafter, for sake of clarity, the TOW indicated at 2B is referred to as fibrous layer 2B.

In order to make opening by means of the sliding plates 11 and 12 effective, it is preferred to apply a tension to the continuous filaments between the paired rolls 4*a* and 4*b* and the paired rolls 5*a* and 5*b*. The peripheral speeds of the paired rolls 4*a* and 4*b* and the peripheral speeds of the paired rolls 5*a* and 5*b* may be the same. However, for appropriately applying tension, it is preferred to make the peripheral speeds of the paired rolls 5*a* and 5*b* higher than the peripheral speeds of the paired rolls 4*a* and 4*b*.

It is preferred that the sliding plates 11 and 12 are so mounted on a not shown supporting member so to permit adjustment of individual penetration amounts of the sliding plates 11 and 12 into the transporting path of the TOW 2A (i.e., the overlapping amount O of the sliding plates 11 and 12) and also permit adjustment of individual tilt angles θ of the sliding plates 11 and 12. In the opening method and opening apparatus using the sliding plates 11 and 12, it becomes possible to adapt to variation of material and fineness of continuous filament, basis weight of the TOW 2A and so forth only by adjusting the penetration amounts (overlapping amount O) and/or the tilt angles θ of the sliding plates 11 and 12. By effecting adjustment from time to time, moreover, quality of the opened fibrous layer 2B can be made stable.

While the adjusting operation can be performed manually, it is also possible to automatically adjust the penetration amounts and the tilt angles θ of the sliding plates 11 and 12 as in the embodiment shown in FIGS. 1 and 2.

In the embodiment shown in FIGS. 1 and 2, in order to achieve automatic adjustment, detecting means 15 for detecting the width W of the fibrous layer 2B of the opened continuous filaments is provided between the paired rolls 6*a* and 6*b* and the roll 7.

The detecting means 15 includes a pair of CCD cameras 16 for confronting two side edges of the fibrous layer 2B and a background plate 17 located at opposite side of the cameras 16 relative to the fibrous layer 2B for confronting the fibrous layer 2B. Since the continuous filaments are white or semi-transparent, the background plate 17 may be provided a color of good contrast in color to the continuous filaments, such as black, dark green and so forth.

An image picked up by the camera 16 is processed by an image processing portion 21 to detect two side edges of the fibrous layer 2B as boundary lines. The position information of the boundary lines detected by the image processing portion 21 is applied to a control portion 22 which takes CPU as primary component. In the control portion 22, the position information of the boundary lines are compared with a preliminarily set threshold value and a correction value is calculated.

On the other hand, on supporting portions of the sliding plates 11 and 12, adjusting means (adjusting actuators) 24*a* and 24*b* which can adjust a moving amount in horizontal direction and the tilt angles θ of the sliding plates 11 and 12, are provided. The adjusting means 24*a* and 24*b* have stepping motors for varying penetration amounts of the sliding plates 11 and 12 into the transporting path of the TOW 2A and stepping motors for varying the tilt angles θ of the sliding plates 11 and 12.

The correction value calculated by the control portion 22 is applied to a driver 23 which controls the adjusting means 24*a* and 24*b*. The driver 23 operates the adjusting means 24*a* and 24*b* on the basis of the correction value.

In the automatic adjustment, the optimal width of the fibrous layer 2B after opening are preliminarily predicted depending upon material and fineness of the continuous filaments and basis weight of the supplied TOW 2A, and information relating to the predicted optimal width is input to the control portion 22. On the basis of the input value, the threshold value is determined. When the width W of the fibrous layer 2B after opening is smaller than the predicted optimal width, adjustment by the adjusting means 24*a* and 24*b* is performed to make the overlapping amount O and/or the tilt angles θ greater. Conversely, when the width W of the fibrous layer 2B after opening is greater than the predicted optimal width, adjustment by the adjusting means 24*a* and 24*b* is performed to make the overlapping amount O and/or the title angles θ smaller.

By performing automatic adjustment in response to material and fineness of the continuous filaments and basis weight of the supplied TOW 2A, optimal opening can be performed constantly and whereby quality of fibrous layer 2B opened becomes stable. Also, when the TOW 2A is varied in material, basis weight or the like, the overlapping amount O and the tilt angles of the sliding plates 11 and 12 can be automatically adapted by only varying setting value input to the control portion 22.

In the embodiment shown in FIG. 1, a production process 30 of a surface layer of an absorbent article is continuously arranged following to the opening process 1.

In the production process 30 of the surface layer, a liquid permeable, heat-fusible base 31 is transported through transporting rolls 32, 33 and 34. The base 31 may be a point bonded non-woven fabric, a through-air bonded non-woven fabric, a spun bonded non-woven fabric, an air-laid non-woven fabric, a span laced non-woven fabric or the like. In such case, use can be made of core-sheath type or side-by-side type conjugated fibers treated to be hydrophilic, such as those of PE/PP, PE/PET or PP/PP. In an alternative, as the base 31, it is also possible to use a film formed of thermoplastic synthetic resin, a laminate sheet of a film and a non-woven fabric, or the like. Furthermore, a foam film formed with a large number of holes by applying vacuum pressure to molten/semi-molten resin on a screen drum, or a film formed with holes by elongation strain by hot needles may also be used.

When the non-woven fabric is used as the base 31, it is preferably corrugated to have wrinkles repeated along transporting direction. The corrugated non-woven fabric can be easily contracted in the transporting direction (Y direction).

On the other hand, the elastic members 35 are supplied through another path other than the path of the base 31. Each elastic member 35 may be made of synthetic rubber or natural rubber and takes form in string or strip. For providing sufficient contracting force for the base 31 in the Y direction, when strain amount in stretching direction is provided in a range of 5 to 50%, preferred contractive tension of one elastic member 35 is in a range of 1.86 to 7.64 mN.

The elastic members 35 are transported by the transporting rolls 36, 37, 38, 39 and 41. The peripheral speed of the transporting roll 37 is higher than that of the paired transporting rolls 36. The peripheral speed of the transporting roll 38 is higher than that of the transporting roll 37. The peripheral speed of the transporting roll 39 is higher than that of the transporting roll 38. The peripheral speed of the paired transporting rolls 41 is higher than that of the transporting roll 39. Between the paired transporting rolls 36 and the paired transporting rolls 41, thus, the elastic members 35 are given a tensile strain in range of 5 to 50%. Thereafter, the elastic members 35 are fixed to the base 31 in a condition where the foregoing tensile strain is applied. Here, the individual elastic member 35 in the form of string or strip are spaced apart from each other in a direction perpendicular to the transporting direction by a constant interval to extend in parallel, and are fixed to the base 31 by a hot melt adhesive or the like.

The fibrous layer 2B opened in the opening process 1 is widened (spread in the width direction) by a widening guide 42 to have a uniform bulkiness. Subsequently, by the paired transporting rolls 33, the fibrous layer 2B thus opened and widened is supplied to the surface of the base 31 having the elastic members 35 fixed on the back face thereof.

Figure 7:
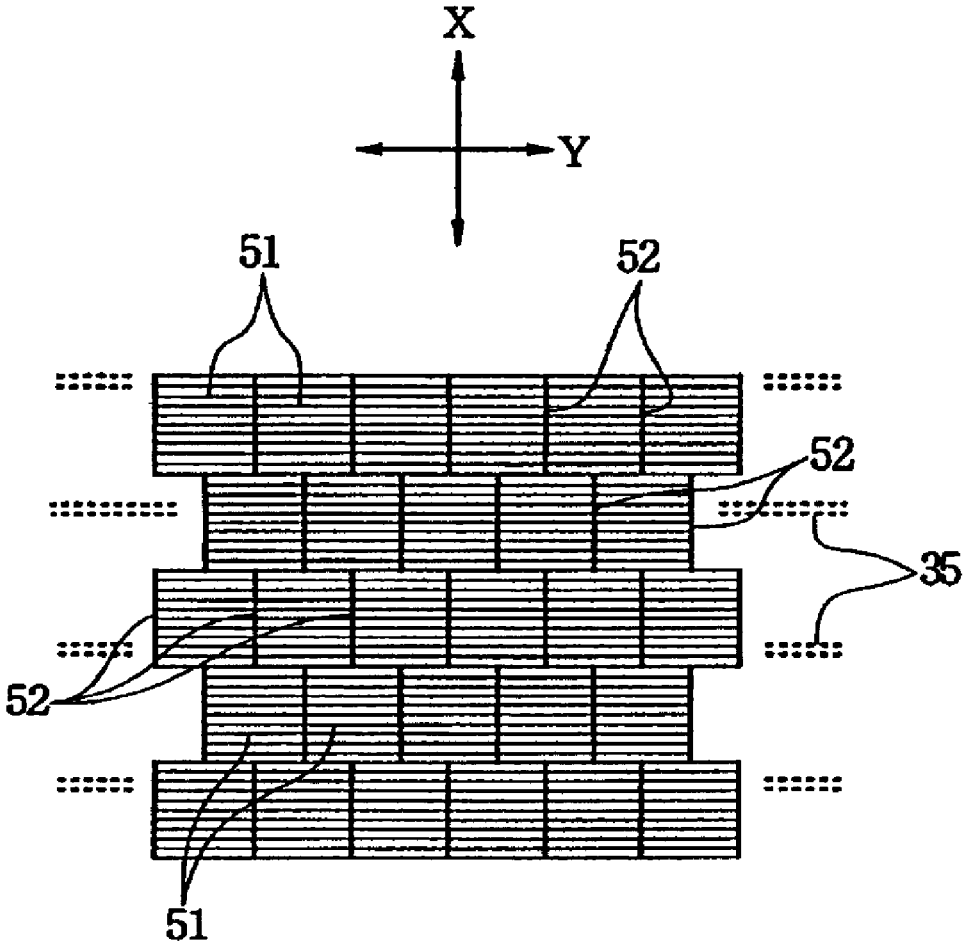
FIG. 7 is a plan view of a surface layer of the absorbent article.

Between the paired transporting rolls 33 and the paired transporting rolls 34, the stack of the fibrous layer 2B, the base 31 and the elastic members 35 is clamped between welding rolls 44 and 45, one of which is provided with emboss for forming fixing lines 52 of a pattern shown in FIG. 7. After passing through the welding rolls 44 and 45, the fibrous layer 2B is partially fixed to the base 31 at the fixing lines 52 as shown in FIG. 7. At this time, the fixing method is heat seal or sonic seal.

On the downstream side of the paired transporting rolls 34, stretching force on the elastic members 35 is released. Then, by elastic contracting force of the elastic members 35, the base 31 is uniformly contracted in the Y direction to make a distance between adjacent fixing lines 52 smaller to form a large number of loop portions 51 from the fibrous layer 2B. Thus, a surface layer 50 is produced.

Figure 8:
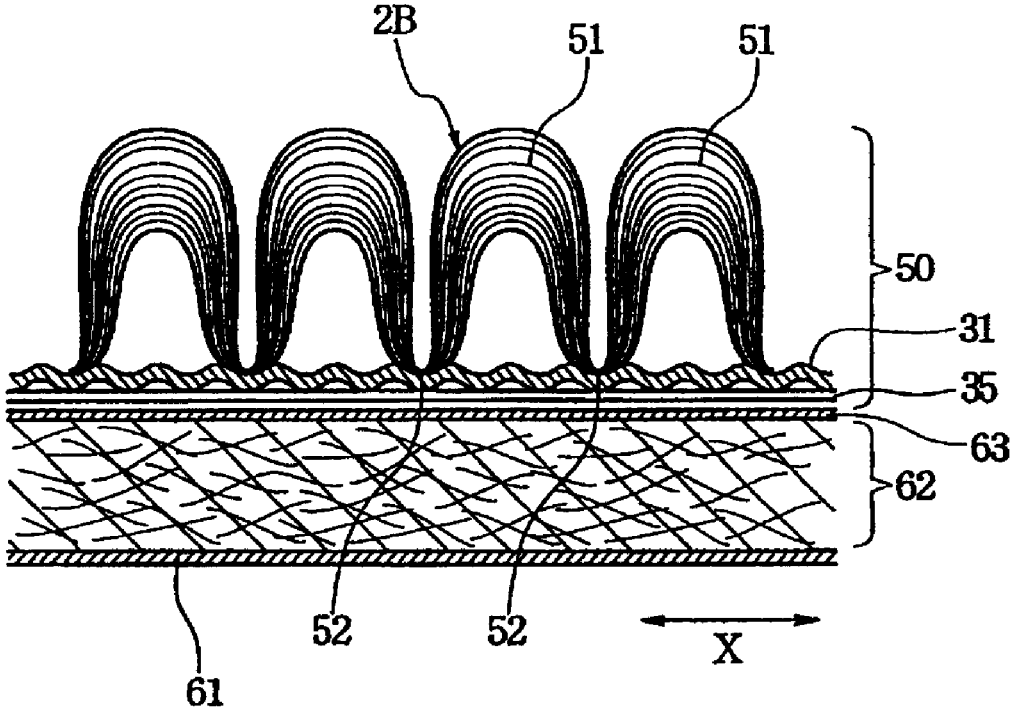
FIG. 8 is a section of the absorbent article and the surface layer.

FIG. 7 is a plan view of the surface layer 50, and FIG. 8 is a section of an absorbent article employing the surface layer 50.

The fixing lines 52 formed by the welding rolls 44 and 45 are formed at a constant pitch in the Y direction. More specifically, the fixing lines 52 are arranged in staggered manner between rows adjacent in the X direction. Therefore, as a result of contraction of the base 31 in the Y direction by elastic contracting force of the elastic members 35, the loop portions 51 are formed respectively between adjacent fixing lines 52 to have relatively large bulkiness. Furthermore, the loop portions 51 can behave independently of each other.

Figure 6:
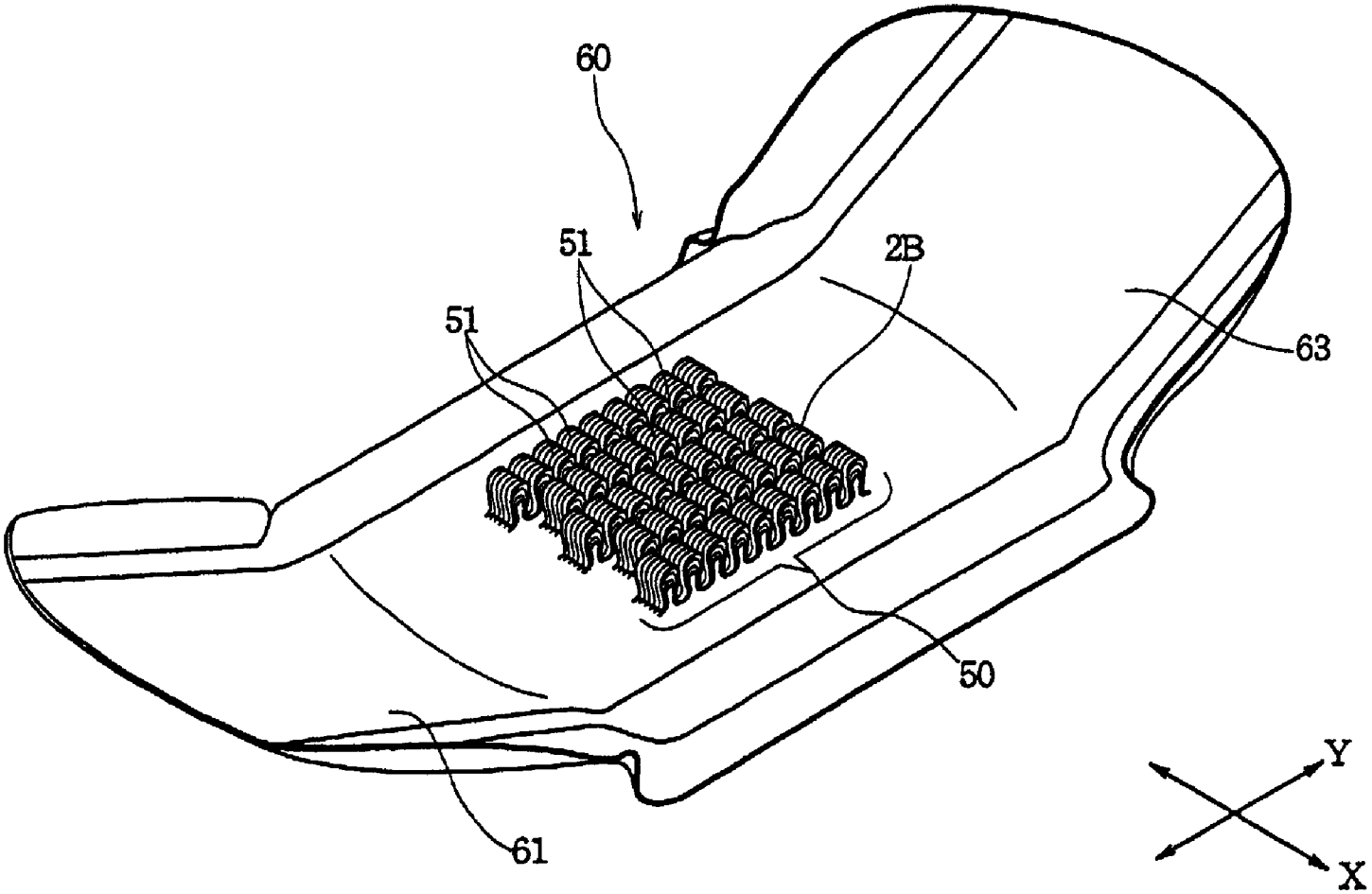
FIG. 6 is a perspective view showing one example of an absorbent article.

FIG. 6 shows a sanitary napkin 60 as one example of the absorbent article. As shown in FIG. 8, the sanitary napkin 60 has a structure, in which a liquid absorbing layer 62 is laid on a liquid impermeable backing sheet 61 and a liquid permeable surface sheet 63 is laid over the liquid absorbing layer 62.

The surface layer 50 formed through the manufacturing process set forth above is located at the center region or the entire region of a liquid receiving surface of the sanitary napkin 60, for example. The surface sheet 63 and the base 31 are partially fixed by a hot melt adhesive.

In the surface layer 50, the loop portions 51 are formed between respectively adjacent fixing lines 52. The continuous filaments of the fibrous layer 2B forming the loop portions 51 have freedom in the X direction and Y direction and have restoring ability against pressure in compression direction. Accordingly, the surface layer 50 may flexibly conform to the skin of a wearer to reduce irritative feeling on the skin. On the other hand, menstrual blood or the like applied to the loop portions 51 flows along the continuous filaments of the loop portions 51 to reach the base 31 to be absorbed in the liquid absorbing layer 62 through the base 31 and the surface sheet 63.

Figure 4:
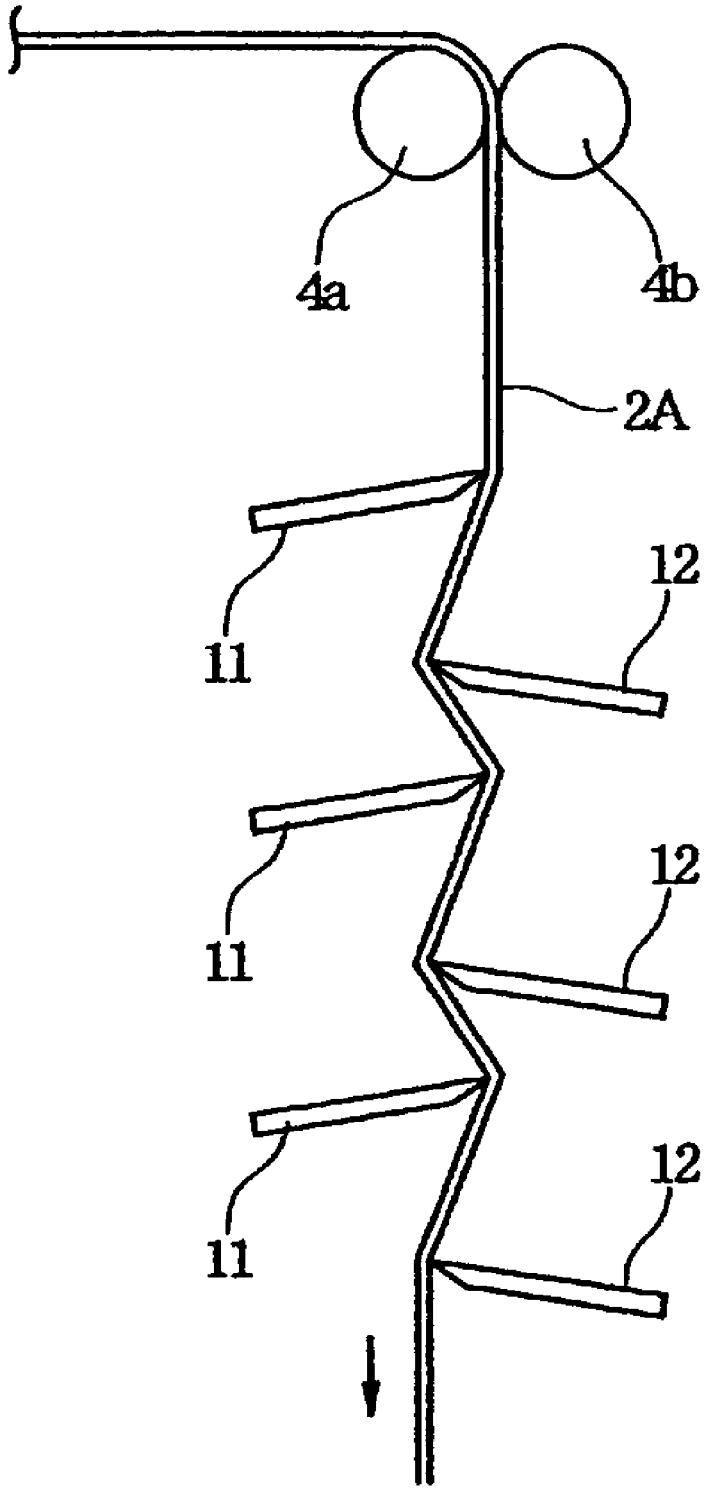
FIG. 4 is a partial side elevation showing another embodiment of the opening method and the opening apparatus.
Figure 5:
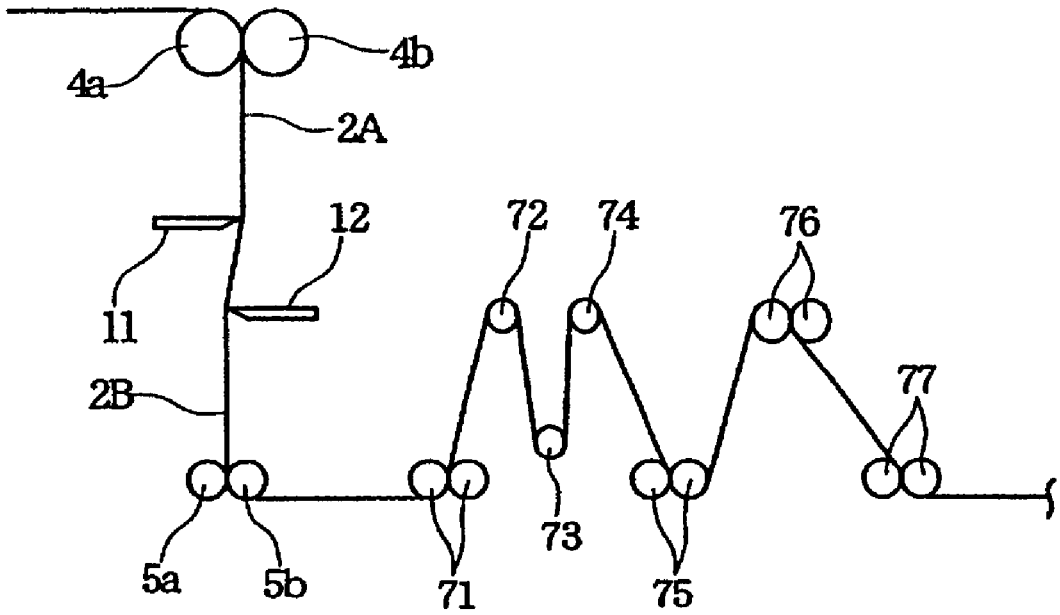
FIG. 5 is a partial side elevation showing still another embodiment of the opening method and the opening apparatus.

Next, FIGS. 4 and 5 are explanatory illustrations showing other embodiments of the present invention.

In the opening process shown in FIG. 4, a plurality of sliding plates 11 and a plurality of sliding plates 12 are provided. By providing the plurality of sliding plates 11 and the plurality of sliding plates 12, which are opposed to each other relative to the TOW 2A, opening of the TOW 2A can be performed more effectively.

In the embodiment shown in FIG. 5, the fibrous layer 2B opened by the sliding plates 11 and 12 is transported by transporting rolls 71, 72, 73, 74, 75, peripheral speeds of which are higher at downstream side roll than the upstream side roll to apply a tension force on the fibrous layer 2B.

Subsequently, the tension force is released by transporting rolls 76 and 77, peripheral speeds of which are lower at the down stream side roll than the upstream roll.

In this embodiment, the fibrous layer 2B opened by the sliding plates 11 and 12 is further processed by applying and releasing tension force, to further progress opening.

On the other hand, in the manufacturing process 30 of the surface layer shown in FIG. 1, elastically contractive base 31 may be employed without using the elastic member 35, or in the alternative, heat shrinking material may be used for the base 31. In this case, after the fibrous layer 2B is fixed at the fixing lines 52 in FIG. 7, the base 31 is contracted by heat shrink for forming the loop portions 51.

As set forth above, with the present invention, the TOW of the continuous filaments can be effectively opened and quality of the fibrous layer after opening becomes stable. Also, it becomes possible to easily adapt for variation of basis weight of the TOW or variation of material or fineness of the continuous filaments.

For manufacturing the absorbent article, such as sanitary napkin, various way has been taken, and the absorbent article may be formed in various structure and configuration. For instance, the absorbent articles and manufacturing process have been disclosed in commonly owned co-pending U.S. patent application entitled "ABSORBENT ARTICLE EMPLOYING SURFACE LAYER WITH CONTINUOUS FILAMENT AND MANUFACTURING PROCESS THEREOF"(claiming priority based on Japanese Patent Application No. 2000-265467) and also in commonly owned co-pending U.S. patent application entitled "ABSORBENT ARTICLE HAVING FIBROUS LAYER ON SURFACE"(claiming priority based on Japanese Patent Application No. 2000-265476). The disclosure of the above-identified commonly owned co-pending U.S. patent applications are herein incorporated by reference.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. An opening method for continuous filaments, comprising the steps of:

transporting crimped tow by means of a plurality of rolls; and applying a resistance on at least one side of said tow by slidingly contacting a plurality of sliding bodies onto said tow at a position between said rolls, whereby continuous filaments stacked in a thickness direction of said tow are caused to shift in a transporting direction of said tow to open said tow and to spread said continuous filaments in a latitudinal direction of said tow, wherein each side of said tow is slidingly contacted by at least one of said sliding bodies, and each sliding body is adjustable about a tilt angle relative to a line perpendicular to a transporting path of said tow and a penetration amount into the transporting path of said tow.

2. The opening method for continuous filaments as set forth in claim 1 further comprising the step of:

detecting a width of spread continuous filaments after slidingly contacting with said sliding bodies, and automatically adjusting said tilt angle and said penetration amount of said sliding bodies based on a detected value.

3. The opening method for continuous filaments as set forth in claim 1, wherein peripheral speeds of rolls located at an upstream side and a downstream side of said sliding body are identical.

4. The opening method for continuous filaments as set forth in claim 1, wherein, among rolls located at an upstream side and a downstream side of said sliding body, a peripheral speed of the roll located at the downstream side is set higher than that of the roll located at the upstream side for applying tension force on said tow between the rolls.

5. An opening apparatus for continuous filaments, comprising:

a transporting roll group for transporting crimped tow of continuous filaments;

a plurality of sliding bodies arranged between rolls of said transporting roll group so that each side of said tow is slidingly contacted by at least one of said sliding bodies;

detecting means for detecting a width of spread continuous filaments after slidingly contacting with said sliding bodies;

adjusting means for adjusting a tilt angle of each sliding body relative to a line perpendicular to a transporting path of said tow and a penetration amount of each sliding body into the transporting path of said tow; and control means for controlling said adjusting means for varying said tilt angle and said penetration amount of each sliding body based on a value detected by said detecting means.

6. The opening apparatus for continuous filaments as set forth in claim 5, wherein said rolls located at an upstream side and a downstream side of said sliding body are driven to rotate at an identical peripheral speed.

7. The opening apparatus for continuous filaments as set forth in claim 5, wherein, among rolls located at an upstream side and a downstream side of said sliding body and driven to rotate, a peripheral speed of the roll located at the downstream side is set higher than that of the roll located at the upstream side.

* * * * *